United States Patent [19]

Crooks et al.

[11] 4,253,775

[45] Mar. 3, 1981

[54] APPARATUS FOR RE-INKING A RIBBON IN A THERMAL TRANSFER PRINTING SYSTEM

[75] Inventors: Walter Crooks, Los Gatos, Calif.; Keith S. Pennington, Somers, N.Y.

[73] Assignee: IBM Corporation, Armonk, N.Y.

[21] Appl. No.: 53,164

[22] Filed: Jun. 29, 1979

[51] Int. Cl.[3] ..... B41J 27/12

[52] U.S. Cl. ..... 400/198; 400/119; 400/241.1; 427/141; 427/49; 118/620

[58] Field of Search ..... 400/198, 199, 118-120, 400/241, 241.1; 427/12, 47, 48, 49, 128-130, 141; 118/620, 621, 625, 638

[56] References Cited

U.S. PATENT DOCUMENTS

| | | | |
|---|---|---|---|
| 3,377,598 | 4/1968 | Borman | 400/198 X |
| 3,413,141 | 11/1968 | Friedman | 427/48 |
| 3,625,334 | 12/1971 | Ahn | 400/198 |
| 3,681,138 | 8/1972 | Ankenbrand et al. | 427/48 |
| 3,731,649 | 5/1973 | Anderson et al. | 400/198 X |
| 3,939,800 | 2/1976 | Banker | 118/621 X |

*Primary Examiner*—E. H. Eickholt

*Attorney, Agent, or Firm*—Pollock, Vande Sande & Priddy

[57] ABSTRACT

A doctor blade is used to apply a powdered toner to the depleted regions of a resistive thermal transfer ribbon. The ribbon is then moved adjacent a heating electrode that passes current through a resistive substrate of the ribbon so that a transverse line on the ribbon is heated and the added toner is fused in the depleted regions of the ribbon. The heated area of the ribbon is thereafter compressed by a cold roller to provide a uniform re-inked surface.

13 Claims, 9 Drawing Figures

FIG-1
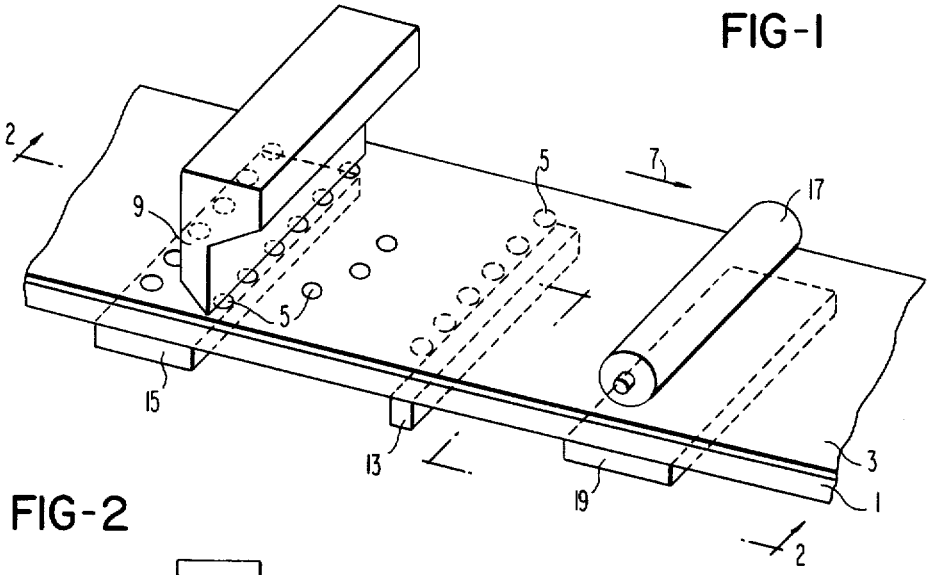
FIG-2
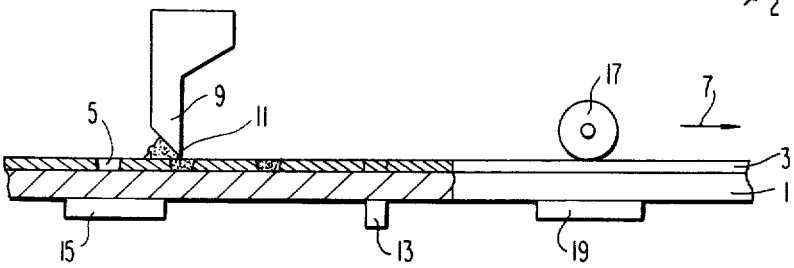
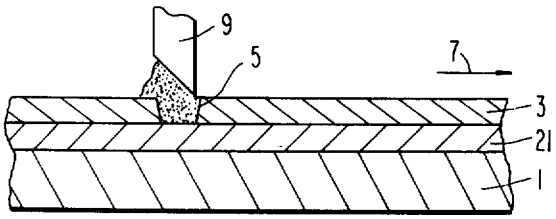
FIG-3
FIG-4
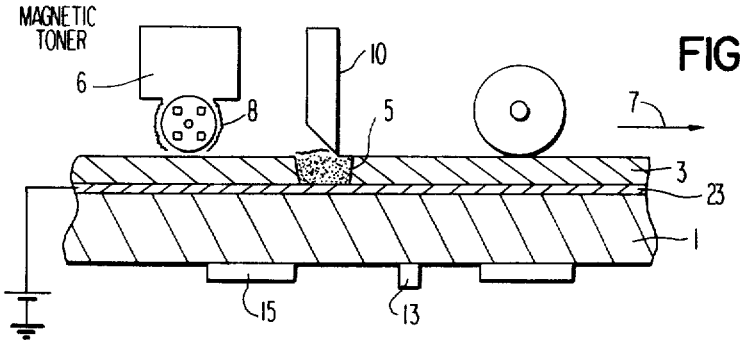

FIG-5a
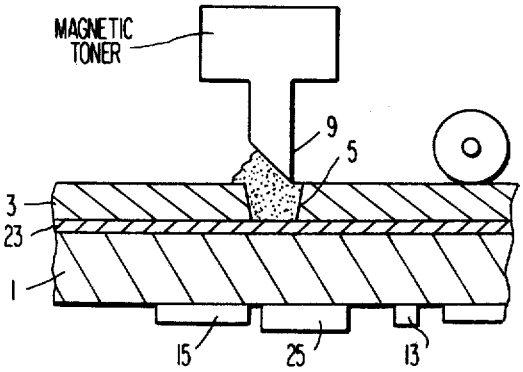
FIG-5b
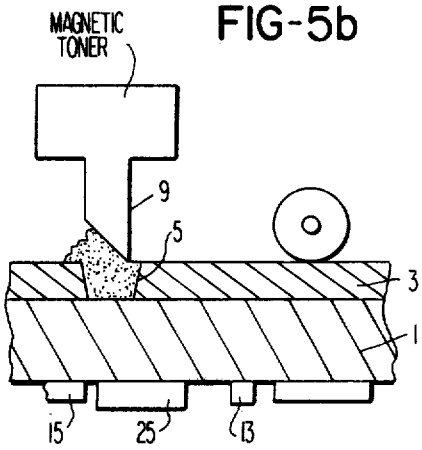
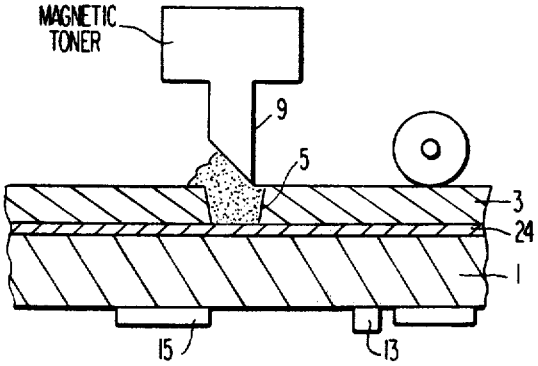
FIG-5c
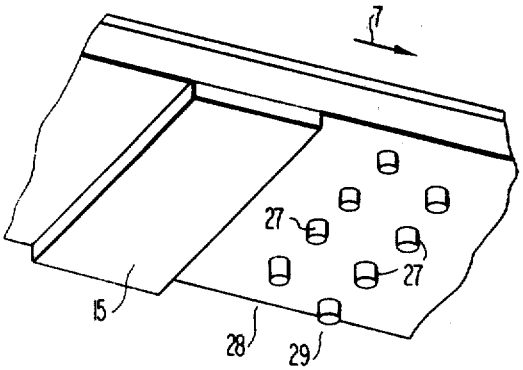
FIG-6a
FIG-6b
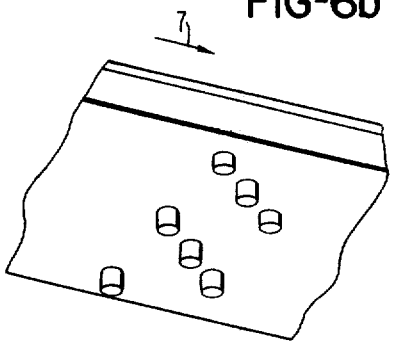

APPARATUS FOR RE-INKING A RIBBON IN A THERMAL TRANSFER PRINTING SYSTEM

DESCRIPTION

1. Technical Field

The invention relates to an apparatus for re-inking a resistive ribbon that is employed for thermal transfer printing, and, more particularly, to such an apparatus that fuses thermoplastic ink to depleted regions of the resistive ribbon by passing a current through the ribbon.

2. Background Art

It is known in the art to electrically heat selected spots of thermally fusible ink on the surface of a resistive ribbon so that corresponding spots of ink are transferred to the surface of a paper that is in contact with the ribbon. Printed characters are formed on the paper by heating particular patterns of spots on the resistive ribbon.

Such prior art thermal transfer printing systems necessarily deplete inked areas on a ribbon as the ribbon is used in the printing process. Thus, once a ribbon is used, it is not possible to reuse the ribbon unless the depleted regions on the ribbon are re-inked in some fashion. Since resistive ribbons are relatively expensive and since such ribbons must necessarily be replaced at frequent intervals if used for high-speed printing applications, it is desirable from an economic standpoint to provide a means for re-inking the depleted regions of a resistive ribbon so that the ribbon may be reused.

It is known in the art to apply a thermally fusible ink to the depleted regions of a ribbon and to heat the ribbon either by thermal conduction or radiation so that the added ink is fused to the ribbon. For example, in the U.S. Pat. to Ahn, No. 3,625,334, it is disclosed to use either a radiant lamp or a nichrome wire to heat a ribbon and associated thermally fusible ink in order to re-ink the ribbon. Moreover, it is disclosed in the U.S. Pat. to Heinzer et al, No. 3,719,261 to heat an electrically conductive ink by means of a heating element and thereafter, to apply the heated ink in a liquid state to re-ink a ribbon. It is also known in the art to heat a ribbon and associated thermally fusible ink by means of a hot roll fuser.

The above-described prior art heating techniques for re-inking a ribbon are undesirable in that they require excessive amounts of energy to fuse ink to a ribbon. For example, a substantial amount of energy is wasted if heating energy must first be used to heat a hot roll fuser or if energy must be employed to first generate heating radiation which is then reconverted to heat by absorption in a ribbon. Also, such heating techniques do not provide "instant on" operation since an intermediate element must be heated before a thermally fusible ink or associated ribbon is heated.

Moreover, if a supply of thermally fusible ink is maintained in a heated condition throughout the re-inking process, a large amount of energy is wasted in heating ink that may not be immediately used in the re-inking process.

Accordingly, it is an object of the invention to provide a relatively simple and energy efficient means for re-inking a resistive ribbon in a thermal transfer printing system.

Another object of the invention is to provide a re-inking apparatus, wherein a heating current is applied directly to the resistive ribbon to heat an inked surface of the ribbon.

These and other objects of this invention will become apparent from a review of the detailed specification which follows and a consideration of the accompanying drawings.

DISCLOSURE OF THE INVENTION

In order to achieve the objects of the invention and to overcome the problems of the prior art, the apparatus for re-inking resistive ribbons, according to the invention, includes a thin line electrode responsive to a pulsed driving current to heat transverse lines of a resistive ribbon having at least a resistive substrate layer and a fusible ink layer.

For a preferred embodiment of the invention, a doctor blade distribution means is employed to fill depleted regions in the surface of a resistive ribbon with a thermoplastic toner. The toner in the depleted regions of the ribbon is heated in response to an electrical current that is applied at the line electrode and that passes to a broad area electrode through an intermediate portion of the resistive substrate. A cold roller then rolls the transverse heated regions of the ribbon to provide a uniform inked surface.

An alternative embodiment of the invention utilizes a layer of silicone rubber between the layers of resistive substrate and fusible ink to adhesively hold the toner in a depleted region.

Another embodiment of the invention includes a metal film disposed between the resistive substrate and the fusible ink layer and means for electrically biasing the metal film to attract a charged electric toner that is disposed in the depleted regions.

An additional embodiment of the invention utilizes either permanent magnets or a magnetic metal layer between the resistive substrate and the fusible ink layer to magnetically attract a magnetic toner so that the toner is maintained in contact with the depleted regions of the ribbon.

A further embodiment of the invention employs two spaced rows of spot electrodes to heat a transverse line of a moving thermal ribbon.

BRIEF DESCRIPTION OF THE DRAWINGS

FIG. 1 illustrates a perspective view, not to scale, of a re-inking apparatus in accordance with the invention.

FIG. 2 illustrates a partial sectional view of the re-inking apparatus of FIG. 1 taken along a line 2—2 in the indicated direction.

FIG. 3 illustrates a sectional view, not to scale, of a first alternative embodiment of the invention.

FIG. 4 illustrates a sectional view, not to scale, of a second alternative embodiment of the invention including means for dispensing a charged toner.

FIGS. 5*a*, 5*b* and 5*c* illustrate cross-sectional views, not to scale, of alternative embodiments of the invention that include apparatus for retaining a magnetic toner.

FIGS. 6*a* and 6*b* illustrate perspective views, not to scale, of alternative embodiments of a heating electrode in accordance with the invention.

BEST MODE FOR CARRYING OUT THE INVENTION

The remaining portion of this specification will describe preferred embodiments of the invention when read in conjunction with the attached drawings, in which like reference characters identify identical apparatus.

FIG. 1 illustrates a perspective view of an apparatus that may be employed to re-ink a resistive ribbon that is used for thermal transfer printing. Such a ribbon typically includes a resistive substrate layer 1 that may be comprised of conductive particles, for example, of graphite, suspended in a high temperature polymer, for example, Kapton. A layer of thermally fusible ink 3 is disposed on the resistive substrate layer 1 and is employed to print patterns on a paper in response to applied heat from an array of printing electrodes (not shown). The resistive ribbon and other components of the apparatus of FIG. 1 are shown out of scale in order to illustrate the features of the invention more clearly.

As is known to those skilled in the art, printing electrodes having a small cross-sectional area of contact may be energized so as to heat small spots on a resistive ribbon which, in turn, heat small spots of the fusible ink of the ribbon. In this way, the thermally fusible ink is heated in patterns corresponding to the letters or other symbols to be printed. As a printing electrode is energized, a corresponding spot on the fusible ink layer 3 is heated and the ink in the heated area flows to form a corresponding spot on the surface of an adjacent paper. Of course, as a result of the transfer of ink in the thermal printing process, depressions or depleted regions 5 are formed in the surface of the layer of fusible ink 3.

As shown in FIG. 1, a resistive ribbon moving in the direction of the arrow 7 and having depleted regions 5 may be re-inked by filling the regions 5 with new thermally fusible ink. More particularly, a doctor blade 9 having a connecting reservoir of thermally fusible ink may be employed to deposit ink in the depleted areas of the ribbon. For example, powdered thermoplastic ink or toner may be dispensed by the doctor blade 9 in a manner known to the art. It should be understood that doctor blading techniques are well known to the art and therefore, the structure of the doctor blade of FIG. 1 is not shown in great detail.

As shown in FIG. 3, as the resistive ribbon moves in the direction of the arrow 7, the depleted regions 5 are moved under the doctor blade 9 and the toner in the reservoir of the doctor blade is deposited in the depression formed at each of the depleted regions of the ribbon. It should be understood that the edge 1 of the doctor blade contacts the surface of fusible ink layer 3 of the ribbon to scrape the surface of the ribbon so that each depleted region on the ribbon is evenly filled with toner.

After a depleted region is filled with toner, the filled region is moved to a position adjacent a narrow line electrode 13 and the electrode 13 is energized so that an electric current flows from the electrode 13 to a broad area electrode 15, through the resistive substrate 1. The current from the line electrode 13 heats the fusible ink layer 3 along the length of the electrode 13 and thereby melts the powdered toner in the adjacent depleted region 5. The heated portion of the ribbon is then pressed between a cold roller 17 and an opposing platen 19 so that a uniform and continuous printing surface is formed.

Although the operation of the re-inking apparatus has been described with reference to a powdered thermoplastic ink or toner, it should be understood that other thermally fusible inks may be employed without departing from the spirit of the invention. For example, a liquid, thermally fusible ink may be applied in the above-described manner. Such a liquid ink may include thermoplastic particles and associated pigment suspended in a solvent, for example, water. Of course, the heat produced at the line electrode 13 will drive off the solvent and will then fuse the remaining solid particulate matter.

The operation of the re-inking apparatus of FIGS. 1 and 2 has been described for a simple resistive ribbon having only a resistive substrate layer 1 and a thermally fusible ink layer 3. However, more complex resistive ribbon structures may be employed for thermal transfer printing. FIG. 3 illustrates a cross-sectional view of a more complex ribbon structure that may be utilized in combination with the re-inking apparatus of FIG. 1 to more effectively apply a thermally fusible ink to a depleted region of a resistive ribbon.

As shown in the cross-sectional view of FIG. 3, the resistive ribbon includes the above-described resistive substrate layer 1 and fusible ink layer 3 and an additional layer of non-conductive material 21, for example, silicon rubber RTV, that has a low temperature adhesive characteristic. In a re-inking operation, a thermally fusible ink, for example, a thermoplastic powdered toner, is applied by a doctor blade 9 to an adjacent depleted region 5 in the above-described manner. However, when the powdered toner is applied to the depleted region 5, the toner is held in position by its adhesive contact with the silicon rubber layer 21.

Thus, as the resistive ribbon moves between the doctor blade 9 and the line electrode 13, the toner is held firmly in contact with the surface of the silicon rubber 21. Therefore, the toner is not jarred out of the region by small movements of the ribbon or by vibrations or other forces transmitted to the ribbon from associated thermal transfer printing apparatus.

FIG. 4 illustrates a cross-sectional view of a resistive ribbon for an alternative embodiment of the invention wherein the resistive ribbon includes the above-described resistive substrate 1 and fusible ink layer 3 and an additional thin film of metal 23, for example, aluminum, copper, iron, nickel or stainless steel. The metal film in the resistive ribbon is employed to confine a current pulse from a printing or re-inking electrode so that the resultant heated area is more sharply defined. It has been experimentally determined that a 0.1 mil metal film may be employed for this purpose in combination with a 0.4 mil resistive substrate. Of course, other thicknesses of the metal film and the resistive substrate may be used without departing from the invention.

As shown in FIG. 4, magnetic toner from a reservoir 6 is electrically charged and applied to a depleted region 5, for example, by a magnetic brush dispenser 8. In operation, the metal film 23 is electrically biased so that the polarity of the metal film is opposite the polarity of the charged toner. Thus, when a quantity of charged toner is moved adjacent a depleted spot 5, the charged metal film 23 attracts the toner and holds the toner within the depleted region. A doctor blade 10 is then employed to evenly distribute the toner within the depleted region.

Magnetic toners and means for charging such toners are well-known to the art. For example, a toner comprised of pigment and magnetic particles in a thermofusible polymer binder may be given an electric charge by contracting teflon-coated magnetic particles on the magnetic brush dispenser 8. The dispenser 8 may include a magnetic drum that is rotated to rub particles of thermofusible polymer in the toner against magnetic teflon-coated particles that are magnetically attached to the outside walls of the drum. Thus, the toner acquires a particular electric charge by triboelectrification. Of course, other triboelectrification techniques, for example, techniques known in the electrographic art as cascade toning or donor toning, may be employed to apply a particular electric charge to a toner without departing from the invention.

FIG. 5*a* illustrates an alternative embodiment of the invention wherein a magnetic toner comprised, for example, of thermoplastic particles, carbon black and magnetite, is applied to a depleted region 5 by a doctor blade 9. As shown in FIG. 5*a*, the resistive ribbon may include a resistive substrate, a fusible ink layer 3, and a metal layer 23. A magnet 25 may be disposed below the resistive substrate 1 to attract the magnetic toner in the depleted region 5 and to thereby hold the toner in the depleted region before the toner is fused by the heating electrode 13.

FIG. 5*b* illustrates an alternative embodiment of the invention wherein the magnet 25 is employed to retain the magnetic toner in the region 5 of a resistive ribbon having only a resistive substrate 1 and a fusible ink layer 3.

FIG. 5*c* illustrates an embodiment of the invention wherein the magnetic toner is retained in the depleted region 5 by the magnetic attraction of a magnetic metal layer 24 that is disposed between the resistive substrate 1 and the fusible ink layer 3.

It should be appreciated that a metal film 23 may be provided adjacent the substrate 1 in the resistive ribbon for the embodiments of FIGS. 1, 2 and 3, without departing from the spirit of the invention. Of course, if such a metal film is included, it need not be either magnetized or electrically biased in the manner described for the embodiments of FIGS. 4 and 5.

If it is desired to reuse a ribbon for only a limited number of times, a re-spreading operation may be employed to re-ink the ribbon. For such an operation, the doctor blade and associated additional toner are not required. Instead, the depleted regions of a ribbon are heated by the line electrode 13 and the heated areas are then rolled by the cold roller 7 so that the remaining heated, thermally fusible ink is spread evenly over the printing surface of the ribbon. Of course, since new toner is not added in this re-spreading operation, the printing quality for each successive use of the ribbon may deteriorate.

FIG. 6*a* illustrates a perspective view of an alternative embodiment of a heating electrode that may be used in place of the line electrode 13 of FIGS. 1–5. As shown in FIG. 6*a*, the heating electrode may be comprised of a plurality of spot electrodes 27 arranged in two closely spaced, parallel rows.

The spot electrodes of one row are displaced with respect to the electrodes of the other row so that the two rows of electrodes in combination may heat a transverse line of a moving resistive ribbon. In operation, as the ribbon moves in the direction of the arrow 7, each of the spot electrodes of a first row 28 is energized by a current driver, for example, a transistor, that provides a pulse of current. The current from the electrodes in the row 28 heats the ribbon at corresponding spots on a transverse line. Thereafter, the line of heated spots is moved to a position adjacent the next row 29 of spot electrodes 27, and the electrodes in the row 29 are energized to heat spots on the surface of the ribbon that are in line with and adjacent to the spots that were previously heated by the row 28 of spot electrodes.

By employing two rows of spot electrodes that are alternately pulsed synchronously with the movement of the resistive ribbon, it is possible to reduce the current requirements for heating a particular line on the ribbon. More particularly, it should be understood that since only one row of spot electrodes is energized at a particular time to heat one half of the area of a line on the ribbon, the instantaneous current required for heating a line is cut in half. Also, since a plurality of spot electrodes are employed, the pulse driving current for each spot electrode is relatively small, thereby ensuring that the spot electrodes may be driven by relatively inexpensive, low power transistors.

It has been experimentally determined that a 100 microsecond to 200 microsecond pulse of current at from 20 ma to 100 ma and from 5 to 25 volts is required for heating and fusing the ink in a 4 mil dot on the ribbon. Of course, such a power requirement is consistent with commercially available TTL transistors.

It should be understood that the heating electrode may include more than two rows of staggered spot electrodes without departing from the spirit of the invention. For example, as shown in FIG. 6*b*, three rows of staggered spot electrodes may be employed to heat areas along a transverse line of a moving resistive ribbon. Of course, for the embodiment of FIG. 6*b*, the three lines of electrodes will be sequentially energized synchronously with the movement of the resistive ribbon.

It should be understood that other types of heating electrodes may be employed without departing from the spirit of the invention. For example, two or more thin, closely spaced electrodes may be employed in combination with a broad area electrode to heat a line on a surface of resistive ribbon. In addition, a single row of spot electrodes may be employed to heat a transverse line on a resistive ribbon. It should also be understood that the power requirements for energizing re-inking electrodes may be further reduced if the energization sequence for printing is stored, for example, in a memory, and is then later employed to control the energization of the re-inking electrodes so that the electrodes only apply heat in areas of the ribbon which have previously been depleted during the printing process. Also, it should be appreciated that the broad area electrode 15 for the embodiments of FIGS. 1–6 may be placed in contact with the resistive substrate of the ribbon at any point along the ribbon in order to establish a path for the heating current of the heating electrode.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A re-inking apparatus for a thermal printing resistive ribbon of a type including an electrically resistive substrate and a thermally fusible ink layer having ink depleted regions, the re-inking apparatus comprising:

dispensing means for adding a quantity of thermally fusible ink to said depleted regions; and electrode means for passing a current through said resistive substrate to heat a portion of the thermally fusible ink layer of said ribbon and to fuse the added thermally fusible ink in depleted regions adjacent the heated portion of the fusible ink layer.

2. The apparatus of claim 1 wherein said dispensing means includes a doctor blade for evenly applying thermally fusible ink to said depleted regions.

3. The apparatus of claim 1 including roller means for pressing a heated portion of said thermally fusible ink layer to define a uniform re-inked surface for the ribbon.

4. The apparatus of claim 1 including retention means for retaining the added thermally fusible ink in said depleted regions.

5. The apparatus of claim 4 wherein said retention means includes an adhesive layer disposed in said ribbon between said resistive substrate and said thermally fusible ink layer for adhering to and retaining the thermally fusible ink disposed in said depleted regions.

6. The apparatus of claim 4 wherein said adhesive layer is silicone rubber RTV.

7. The apparatus of claim 4 wherein said thermally fusible ink is magnetic and said retention means includes at least one magnet disposed adjacent said resistive substrate for magnetically attracting and retaining the magnetic thermally fusible ink disposed in adjacent depleted regions.

8. The apparatus of claim 4 wherein said thermally fusible ink is magnetic and said retention means includes a magnetic layer disposed in said ribbon between said resistive substrate and said thermally fusible ink layer for magnetically attracting and retaining the thermally fusible ink disposed in said depleted regions.

9. The apparatus of claim 4 wherein said thermally fusible ink is electrically charged and said retention means includes an electrically biased conductive layer disposed between said resistive substrate and said thermally fusible ink layer for electrically attracting and retaining the charged thermally fusible ink disposed in said depleted regions.

10. The apparatus of claim 1 wherein said electrode means includes a line electrode extending across said resistive ribbon and an area electrode arranged in a spaced relation to said line electrode, said line electrode defining a heated line on said ribbon when current flows between the line electrode and the area electrode through an intermediate portion of said resistive substrate.

11. The apparatus of claim 1 wherein said electrode means includes a plurality of spot electrodes arranged in at least one line extending across said resistive ribbon, and an area electrode arranged in a spaced relation to said at least one line of spot electrodes, each of said spot electrodes defining a corresponding heated spot on the fusible ink layer of said ribbon when current flows between the spot electrode and the area electrode through an intermediate portion of said resistive substrate.

12. The apparatus of claim 11 wherein said spot electrodes are arranged in at least two spaced lines, the spot electrodes of each line being spaced from one another along the line and positioned adjacent the spaces between the spot electrodes of the other lines, the spot electrodes of each line being energized synchronously with a moving resistive ribbon to heat corresponding areas along a line on the fusible ink surface of the ribbon.

13. A re-inking apparatus for a thermal printing resistive ribbon including an electrically resistive substrate and a thermally fusible ink layer having ink depleted regions, the re-inking apparatus comprising:

electrode means for passing a current through said resistive substrate to heat a portion of the thermally fusible ink layer; and roller means for pressing the heated portion of said thermally fusible ink layer and spreading heated ink from areas adjacent a depleted region into the depleted region to define a uniform re-inked surface for the ribbon.

* * * * *